United States Patent [19]

Abrams et al.

[11] Patent Number: 4,662,950

[45] Date of Patent: May 5, 1987

[54] METHOD OF MAKING A STEEL PLATE FOR CONSTRUCTION APPLICATIONS

[75] Inventors: Halle Abrams, Allentown; John R. Paules, Coopersburg, both of Pa.

[73] Assignee: Bethlehem Steel Corporation, Bethlehem, Pa.

[21] Appl. No.: 795,300

[22] Filed: Nov. 5, 1985

[51] Int. Cl.[4] ..... C21D 8/02

[52] U.S. Cl. ..... 148/12 F; 148/12.1

[58] Field of Search ..... 148/36, 12 F, 12.1, 148/2

[56] References Cited

U.S. PATENT DOCUMENTS

| | | | |
|---|---|---|---|
| Re. 31,251 | 5/1983 | Nakasugi et al. | 148/12 F |
| 3,132,025 | 5/1964 | Hurley | 148/36 |
| 3,860,456 | 1/1975 | Repas | 148/36 |
| 3,897,279 | 7/1975 | Shaughnessy et al. | 148/36 |
| 4,397,697 | 8/1983 | Freier et al. | 148/36 |
| 4,534,805 | 8/1985 | Jesseman | 148/12 F |

FOREIGN PATENT DOCUMENTS

| | | | |
|---|---|---|---|
| 52-61122 | 5/1977 | Japan | 148/12 F |

*Primary Examiner*—L. Dewayne Rutledge
*Assistant Examiner*—Deborah Yee
*Attorney, Agent, or Firm*—William B. Noll

[57] ABSTRACT

A steel plate product, and the method for producing same, wherein the plate, in thicknesses up to 4.0 inches, is characterized in the as-rolled condition by high strength, a uniform fine grain size, and good toughness at low temperatures. The processing techniques include among other features a modified controlled rolling practice.

5 Claims, 3 Drawing Figures

METHOD OF MAKING A STEEL PLATE FOR CONSTRUCTION APPLICATIONScl

BACKGROUND OF THE INVENTION

This invention is directed to an as-rolled, high-strength, fine grained steel plate, having good low temperature toughness in thickness up to 4.0 inches, and to the method of producing same.

Heretofore, in the desire to produce steel plate, in the range of 1.0 to 4.0 inches while possessing adequate properties for construction applications, it was necessary to either rely upon extensive amounts of alloying additions or time consuming processing, such as normalizing or quenching and tempering, to achieve the results. The present invention is based on technology which avoids the extensive alloying or time consuming processes.

Through years of experience in processing thick sectioned steel, i.e. plate, the worker skilled in the art has gained knowledge on those factors or procedures for developing certain metallurgical properties. For example, it is generally agreed that in HSLA steels grain refinement is the most effective means of increasing strength as well as improving the notch toughness. A fine ferrite grain size contributes to strengthening by the well known Hall-Petch relationship. Similarly, a $d^{-\frac{1}{2}}$ relationship contributes to improved toughness in accordance with the Petch-Heslop equation. Furthermore, controlled-rolling produces a finer ferrite grain size than either conventional hot-rolling or normalizing. However, the presence of a duplex microstructure consisting of fine and coarse ferrite grains, causes a decrease in the notch toughness when compared to a uniform fine grained ferrite microstructure. Accordingly, for a given steel composition, to reduce or eliminate the duplex ferrite/pearlite microstructure, control-rolled HSLA plate steel development has concentrated on optimizing the complex time-temperature-deformation interactions that occur during plate processing. From extensive prior experimental work the importance of the fine grained ferrite regions as a critical microstructural parameter responsible for improved notch toughness was recognized. Further, knowledge of the application of lower slab reheating temperatures to reduce coarse grained ferrite regions and the degree of duplex microstructure was gained.

It is also well known that achievement of a fine grained ferrite microstructure in a control-rolled HSLA steel requires structural refinement or conditioning of the parent austenite phase. In this regard, from a microalloying addition viewpoint, columbium (Cb) plays a major role because it is a potent inhibitor of austenite recrystallization. The mechanism for the retardation of austenite recrystallization by Cb has been attributed to either a solute drag effect or strain induced precipitation of fine columbium carbonitrides. Certain reported work has shown that there is a significant delay in recrystallization caused by a solute effect. On the other hand, strain induced precipitation of columbium carbonitrides has been reported to occur at the very high temperatures of 1000° C. to 1150° C. (1832° F. to 2102° F.). In general, the recrystallization retardation effect is much stronger for fine precipitates than for the solute drag effect.

Regardless of the mechanism responsible, there is a critical temperature ($T_R$) for Cb inhibiting austenite recrystallization, such that upon rolling there results a pancaked austenite. A more pancaked austenite will effectively produce a finer ferrite grain size, since nucleation of the ferrite occurs at the austenite grain boundaries. Thus, the height of the pancaked austenite, or more precisely the ratio of boundary surface area to volume for the austenite grains is one of the determining factors in controlling the ferrite grain size.

In work by Tanaka, et al, "Formation Mechanism Of Mixed Austenite Grain Structure Accompanying Controlled-Rolling Of Niobium-Bearing Steel," *Thermomechanical Processing Of Microalloyed Austenite,* DeArdo, Ratz and Wray, Eds., AIME pp. 195–215, 1982, the authors report on the existence of both partial-recrystallized and non-recrystallized austenite regions, and has proposed that there is a critical amount of deformation, which increases rapidly with decreasing rolling temperature, to cause recrystallization. For all practical purposes, these critical deformation reductions are so high at typical controlled-rolling temperatures that the accumulated strain energy introduced into the plate produces deformation bands. These deformation bands produced by rolling in the partial- and non-recrystallized austenite regions play a significant role in producing a fine grained ferrite microstructure, since ferrite nucleation occurs at deformation bands as well as at austenite grain boundaries. Furthermore, deformation bands are difficult to generate in coarse grained austenite. Thus, the best approach to achieving a uniform, fine grain ferrite microstructure is to obtain as fine a recrystallized austenite grain size as possible, followed by a large amount of deformation in the partial- and non-recrystallized austenite regions.

Through research and mill experimentation we were able to combine and interrelate the desirable procedures into a practice to develop an as-rolled, high-strength, fine grained steel plate, having good low temperature toughness in thicknesses up to 4.0 inches. Such practice will become apparent by the specification which follows.

SUMMARY OF THE INVENTION

This invention is directed to a method of thermomechanically treating steel to produce plates having a thickness of at least 1.0 inch, preferably up to 4.0 inches, and to the product thereof. The as-rolled steel is characterized by a uniform, fine grained microstructure, and a low temperature ($< -10°$ F.), longitudinal CVN of at least 25 ft-lb in thicknesses up to 4.0 inches. The method comprises the steps of:

(A) preparing an aluminum killed steel mass suitable for rolling from an alloy consisting essentially of, by wt. %:
C—0.23 max
Mn—1.35 max
P—0.04 max
S—0.05 max
Si—0.50 max
V—0.10 max
Cb—0.02-0.06
Ni—0.50 max
Cr—0.70 max
Cu—0.40 max
Fe—balance (B) heating said mass to temperature within the range of 2050° to 2150° F. for a period of time, depending on the slab thickness, to uniformly heat the slab, (C) subjecting said mass to a first series of reductions of about 50 to 60% total reduction, and (D) finish rolling with a reduction of between 40 and 50% and a finishing temperature of about 1600° F., to produce an as-rolled plate having a thickness of at least 1.0 inch.

DETAILED DESCRIPTION OF PREFERRED EMBODIMENT

Figure 1A:
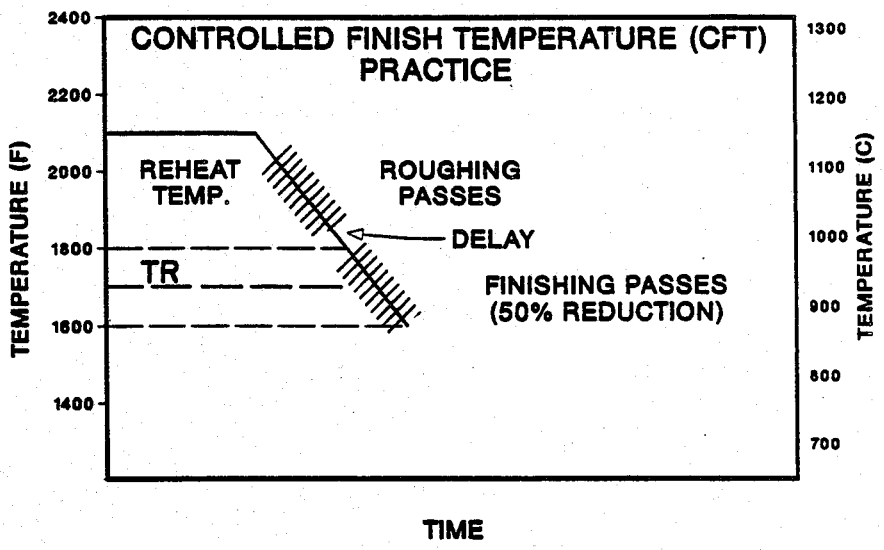
FIGS. 1A and 1B are schematic representations of the temperature-time relationship in a controlled finish temperature (CFT) practice according to the present invention, and conventional hot rolling practice, respectively.

The present invention relates to a method, and the product thereof, whereby a selected steel chemistry is subjected to a modified controlled-rolling practice to produce minimum 50 ksi (345 MPa) yield strength plates up to 4 in. (100 mm) thickness with excellent notch toughness. For purposes of further description, such practice will be designated controlled finishing temperature (CFT) practice. The practice is most suitable in combination with Cb-containing microalloyed steels, such as ASTM A808, as well as conventional structural grades modified with Cb, as covered by ASTM specifications A572 and A588. Preferably, such Cb will be present in an amount between about 0.02 to 0.04%, by weight.

The thermomechanical treatment cycle of this invention is a critical parameter to achieving the desired results. Specifically, the CFT practice is a plate rolling procedure that tailors the time-temperature-deformation process by controlling the following rolling parameters; slab reheat temperature, transfer gage, transfer temperature, intermediate gage, intermediate temperature, delay time, finish temperature, and percent reduction. This differs from a normal hot rolling practice which takes advantage of the better hot workability of the material at higher temperatures, and rolls the plate to the final thickness as quickly as possible. These differences are shown schematically in FIGS. 1A and 1B which are plots of temperature versus time. As indicated, CFT rolling involves deformation at much lower temperatures than hot rolling, but not into the two phase austenite-ferrite region. In addition, a hold or delay is generally taken between the roughing and finishing stands to allow time for the partially rolled slab to cool to the desired intermediate temperature for the start of final rolling. Furthermore, this practice produces a finer austenitic grain size, which is more amenable to the development of deformation bands during the subsequent processing, thereby producing a more refined and uniform ferrite microstructure. Furthermore, at least one pass is taken below $T_R$ to form a pancaked austenite, which upon transformation forms a finer ferrite grain size.

To demonstrate the suitability of the CFT practice to rolling steel plate, a series of three steel compositions (Table I) were air induction melted and cast into ingots. To simulate actual mill practice, and to monitor carefully the practice being followed, the ingots were subjected to an initial hot rolling and air cooling to yield slabs for practicing the CFT practice.

TABLE I

| | COMPOSITION* | | | | | | | | | | |
|---|---|---|---|---|---|---|---|---|---|---|---|
| Steel | C | Mn | P | S | Si | V | Cb | Cu | Ni | Cr | N |
| 1. | .20 | 1.20 | .02 | .02 | .22 | .05 | .04 | — | — | — | .01 |
| 2. | .13 | 1.10 | .02 | .02 | .25 | .01 | .03 | .30 | .35 | .55 | .01 |
| 3. | .08 | 1.35 | .02 | .004 | .29 | .07 | .04 | — | — | — | .01 |

*balance iron, except for incidental impurities, including Al to provide for full killing and fine grain.

Figure 1B:
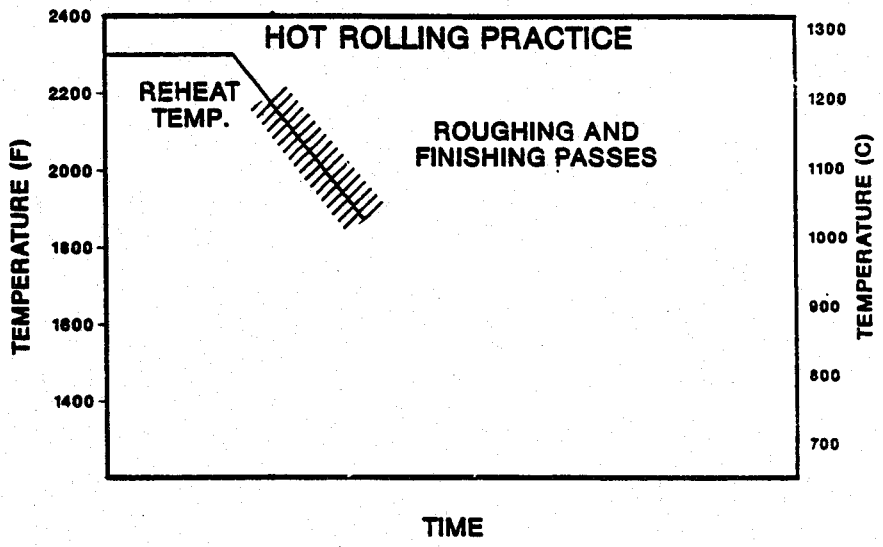
FIG. 1B PRIOR ART

As shown in FIG. 1A, the slabs, in thicknesses between 4 and 8 inches, were heated to approximately 2100° F. (1149° C.) and held for a sufficient time to be substantially uniform in temperature throughout. All slabs were subjected to the CFT practice. That is, from such soaking temperature the slabs were subjected to a series of roughing passes, above the two phase austenite-ferrite region, to effect a reduction of about 50%. The slabs were then removed from the roughing operation and held for approximately two minutes. As seen in FIG. 1A, the average temperature of the slabs dropped to about 1800° F. (982° C.) where the final rolling was effected. Such rolling is accomplished within the range of about 1800° F. to 1600° F. (982° C. to 871° C.), and should produce a reduction of at least 30%. The last reduction, or rolling pass, should be completed before reaching a temperature of about 1600° F. (871° C.) so as to perform mechanical working below the $T_R$ temperature for the given steel composition. This results in a fine ferrite grain size and improved mechanical properties, such as high strength and good toughness. Thereafter, the rolled plate, having a thickness of between 1.0 and 4.0 inches , is aircooled to ambient temperature.

A typical plate, having a composition comparable to Steel 1 of Table I, and processed according to the CFT practice to a final thickness of 3.0 inches, will exhibit the following properties:

| | | |
|---|---|---|
| Y.S. 55.6 ksi | T.S 78.4 ksi | % el (2") 26% |
| CVN (longitudinal) @ | −10° F. 42 ft-lb | |

For highway construction applications, a stringent toughness requirement has been established, namely, AASHTO Zone 3 fracture critical toughness, in service environments down to −60° F. (−51° C.). Heretofore, with plates up to 2.0 inches in thickness, it was possible to satisfy the above standard through microalloying and normalizing. However, from plate thicknesses beyond 2.0 and up to 4.0 inches, macroalloying plus quenching and tempering (Q&T) were necessary. Now, by following the CFT practice, such standard can be met without expensive heat treatment, i.e. normalizing or Q&T.

Figure 2:
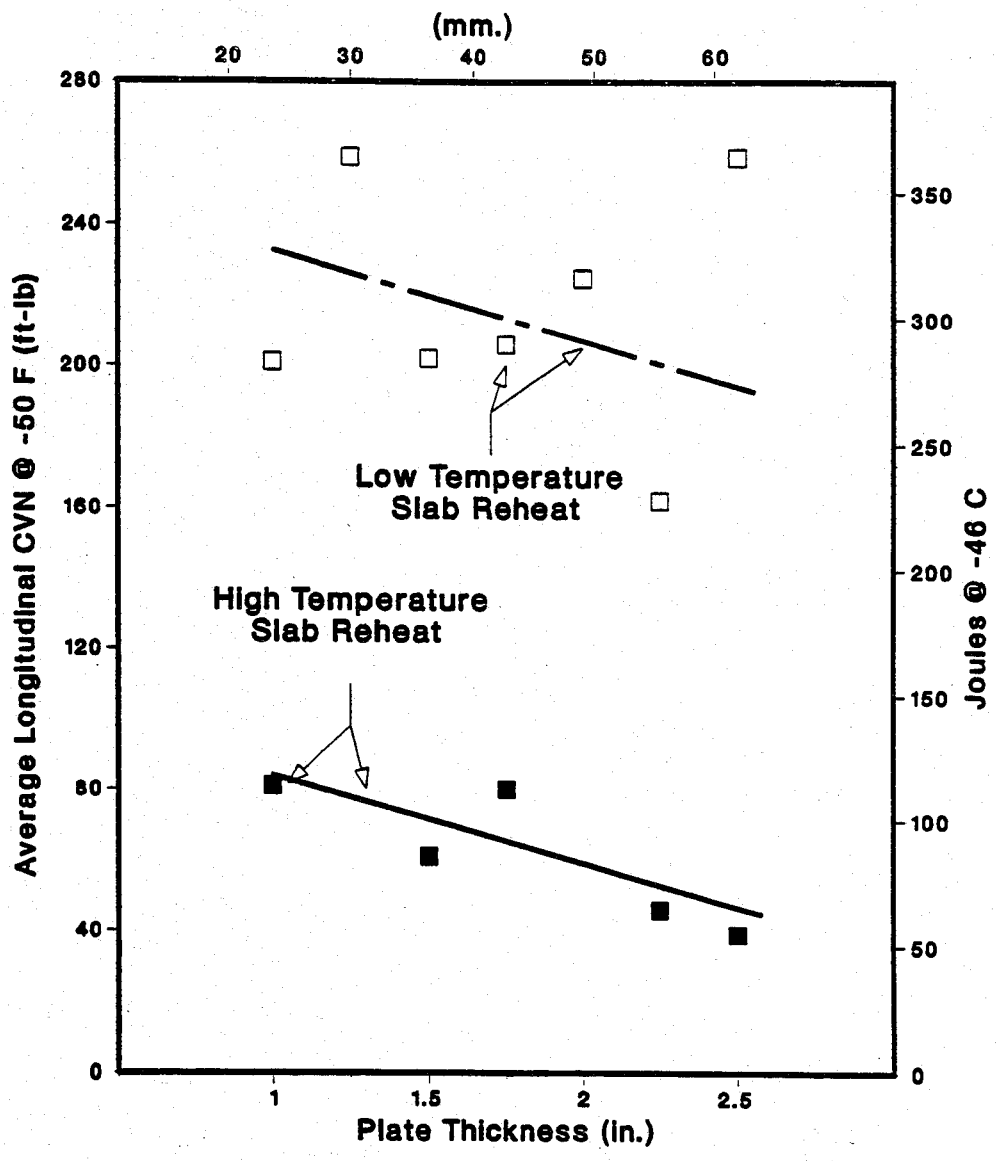
FIG. 2 is a graphic presentation of data showing the improvement in using a low-temperature slab reheating practice in conjunction with CFT.

An important feature of the CFT practice is the low-temperature slab reheating temperature. Typically, prior art practicioners deemed it necessary to select slab reheating temperatures at about 2250° F. and above to insure full solubility of alloying elements within the steel, and to maintain adequate yield strengths. It has now been determined that a low temperature slab reheating practice, preferably between about 2050° and 2150° F., is particularly beneficial to improving toughness. FIG. 2 illustrates the dramatic increase in toughness by reducing the slab reheat temperature from about 2300° to 2100° F. Additionally, only a slight lowering of the strength levels was noted. This, however, may be attributed to the effect of incomplete solubility of aluminum nitrides. In any event, the loss in strength is not very significant.

The low slab reheat temperature also affects grain size. That is, low temperature slab reheating produces a fine, uniform ferrite grain size. At the lower slab reheating temperatures, i.e. 2100° F. (1149° C.), not all of the columbium carbonitride precipitates go into solution. These precipitates restrict austenite grain growth during slab reheating, resulting in a fine, uniform austenitic grain size. The austenite is refined further during rolling, and upon transformation a fine, uniform ferritic microstructure is obtained. With CFT processing, a uniform ferritic grain size of 5.5 μm can be obtained.

We claim:

1. A method of thermomechanically treating steel to produce plates having a thickness of at least 1.0 inch, where said steel is characterized by a uniform, fine grained microstructure, a low temperature (−10° F.) longitudinal CVN of at least 25 ft-lb, and at least 50 ksi Y.S., in thicknesses up to 4.0 inches, said method comprising the steps of:

(A) Preparing an aluminum killed steel mass suitable for rolling from an alloy consisting essentially of by weight %:

C —0.23 max
Mn—1.35 max
P—0.04 max
S—0.05 max
Si—0.50 max
V—0.10 max
Cb—0.02-0.06
Ni—0.50 max
Cr—0.70 max
Cu—0.40 max
Fe—balance, (B) heating said mass in which the columbium is present as carbonitride precipitates to a substantially uniform temperature within the range of 2050° to 2150° F., whereby not all of said columbium carbonitride precipitates go into solution, (C) subjecting said mass to a first rolling reduction of between 40 to 60%, and (D) a second rolling reduction at a temperature below about 1800° F. with a reduction between about 40 to 60% and a finishing temperature no less than about 1600° F., where at least one rolling pass shall be below the $T_R$ temperature, the temperature at which columbium inhibits austenite recrystallization, to produce an as-rolled plate having a thickness of at least 1.0 inch, and a fine, uniform ferritic microstructure.

2. The method according to claim 1 wherein Cb is present in an amount of between 0.02 and 0.04%.

3. The method according to claim 1 wherein said first reduction is at least 50%.

4. The method according to claim 1 wherein the final plate thickness is at least 2.0 inches.

5. The method according to claim 2 wherein the final plate thickness is at least 2.0 inches.

* * * * *